US005456317A

United States Patent [19]

Hood, III, et al.

[11] Patent Number: 5,456,317

[45] Date of Patent: Oct. 10, 1995

[54] BUOYANCY ASSISTED RUNNING OF PERFORATED TUBULARS

[76] Inventors: John L. Hood, III, 300 Sawgrass La., Broussard, La. 70518; J. David Payne, 28 Pinta, West Moorings by the Sea, Port of Spain, Trinidad/Tobago

[21] Appl. No.: 188,093

[22] Filed: Jan. 28, 1994

Related U.S. Application Data

[63] Continuation-in-part of Ser. No. 127,889, Sep. 27, 1993, which is a continuation of Ser. No. 560,380, Jul. 31, 1990, abandoned, which is a continuation-in-part of Ser. No. 486,312, Feb. 28, 1990, abandoned, and a continuation-in-part of Ser. No. 401,086, Aug. 31, 1989, Pat. No. 4,986,361.

[51] Int. Cl.[6] ..... E21B 43/00

[52] U.S. Cl. ..... 166/296; 166/50; 166/376; 166/380

[58] Field of Search ..... 166/242, 296, 166/376, 380, 50

[56] References Cited

U.S. PATENT DOCUMENTS

| | | | |
|---|---|---|---|
| 1,508,586 | 9/1924 | Baker | 166/242 X |
| 2,913,051 | 11/1959 | Lister | 166/296 X |
| 3,273,641 | 9/1966 | Bourne | 166/12 |
| 3,332,499 | 7/1967 | Harris et al. | 166/307 X |
| 3,333,635 | 8/1967 | Crawford | 166/12 |
| 3,983,941 | 10/1976 | Fitch | 166/276 |
| 4,018,282 | 4/1977 | Graham et al. | 166/296 X |
| 4,498,543 | 2/1985 | Pye et al. | 166/376 |
| 4,664,191 | 5/1987 | Jennings, Jr. | 166/276 |
| 5,205,365 | 4/1993 | Quintana | 166/380 X |
| 5,219,028 | 2/1992 | Martin et al. | 166/380 |

*Primary Examiner*—Hoang C. Dang
*Attorney, Agent, or Firm*—William O. Jacobson; Gregory F. Wirzbicki

[57] ABSTRACT

The perforations of a pre-perforated tubular are plugged with interior protruding, mostly hollow plugs which temporarily seal the perforations. The plugs are capable of withstanding a significant pressure differential and, when combined with an insert, forming a flotation cavity containing a buoyant fluid. The temporarily sealed tubular is then run into a wellbore, the tubular is set, and the plugs are unsealed. The unsealing is preferably accomplished by drilling out the interior protruding portions. Solid baffles may also be placed in the string to limit buoyant fluid loss in the event of premature unsealing in another embodiment of the invention.

21 Claims, 4 Drawing Sheets

BUOYANCY ASSISTED RUNNING OF PERFORATED TUBULARS

This application is a continuation-in-part of application Ser. No. 08/127,889 filed Sep. 27, 1993, which is continuation of application Ser. No. 07/560,380, filed Jul. 31, 1990, now abandoned, which is a continuation-in-part of application Ser. No. 07/486,312, filed Feb. 28, 1990, now abandoned, and application Ser. No. 07/401,086, filed Aug. 31, 1989, now U.S. Pat. No. 4,986,361. All of these prior filed applications are incorporated in their entirety herein by reference.

FIELD OF THE INVENTION

This invention relates to well drilling devices and processes. More specifically, the method of the invention reduces the drag generated by perforated tubulars being run into a deviated wellbore.

BACKGROUND OF THE INVENTION

Many well completions involve setting a liner, casing, or other tubular string within a portion of a hole or wellbore. In some wells, such as extended reach wells drilled from platforms or "islands," a string must be set in a slant drilled (i.e., inclined angle) portion of a deviated hole. The inclined angle (from vertical) of these deviated hole portions frequently approaches 90 degrees, i.e., horizontal, and sometimes exceeds 90 degrees. Current state-of-the-art techniques allow extensive drilling of wellbores at almost any incline angle, but problems have been experienced in completing long, highly deviated wellbores, especially related to the setting of pre-perforated casing or liner strings.

A liner or casing string may be pre-perforated before being run and set in a rotary or pre-drilled wellbore in order to avoid a downhole perforating step. Although the drill string and drill bit used to cut the hole is typically rotated, thereby avoiding static friction drag forces which retard the pipe string from sliding into the hole, shape and other limitations of the tubulars being run typically precludes rotation. The tubulars being set are typically larger in diameter than the typical drill string and the torsional forces needed to rotate the casing or liner can be greater than the torsional strength of the pre-perforated tubulars or greater than the available rotary torque. Casing or liner strings are therefore normally run (i.e., slid) into the hole without drag reducing rotation.

Running tubulars in highly deviated holes can result in a significantly increased risk of a stuck tubular, especially when running a pre-perforated liner or casing. A pre-perforated casing or liner pipe string may become differentially stuck before reaching the desired setting depth during running into a deviated or high drag hole, especially when the perforations create added drag and if the incline angle exceeds a critical angle. The critical angle is defined as when the weight of the casing or liner in the wellbore produces more drag force than the component of weight tending to slide the casing or liner down the hole. If sufficient additional force (up or down) cannot be applied to a stuck tubular, the result may be a stuck tubular and effective loss of the well. Even if a stuck string is avoided, the forces needed to unstick the tubular may cause serious damage to the drill pipe or tubulars, especially when the tubular is pre-perforated.

SUMMARY OF THE INVENTION

Such problems are avoided in the present invention by temporarily blocking axial flow within a pre-perforated tubular and temporarily plugging the perforations. Plugging the perforations with interior protruding, mostly hollow plugs prior to running the tubular into a wellbore forms a flotation cavity which excludes a high density fluid contained within the wellbore from entering the tubular. The plugs are also capable of containing a lower density fluid within the tubular and withstanding a significant pressure differential when the lower density fluid within the flotation cavity is at a significantly lower pressure than the high density fluid within the wellbore annulus outside the tubular.

The temporarily sealed and more buoyant tubular is then run into the wellbore, set, and the plugs unsealed. Unsealing the mostly hollow plugs is typically accomplished by drilling out the interior-protruding portion of the plugs. One or more baffles may also be placed in the flotation cavity to limit lower density fluid loss in the event of premature unsealing of the temporary plugged perforations.

Although an open bottom end of the tubular can be used for deviated wellbore portions inclined at less than 90 degrees, a packer and a float shoe or collar can be used to more reliably trap air or other lower density fluids within a portion of the plugged string being run in a deviated hole. A float shoe at the bottom of the string prevents fluid inflow as the string is lowered into the (high density) fluid-filled well bore, but may allow fluid outflow. A packer or other insert is attached to an upper portion of the casing and forms the other end of the flotation cavity portion. After running the string to the desired setting depth in the fluid-filled hole, the insert and interior portions of the plugs are drilled out.

BRIEF DESCRIPTION OF THE DRAWINGS

In these Figures, it is to be understood that like reference numerals refer to like elements or features and distances are not drawn to scale.

DETAILED DESCRIPTION OF THE INVENTION

Figures 1, 2:
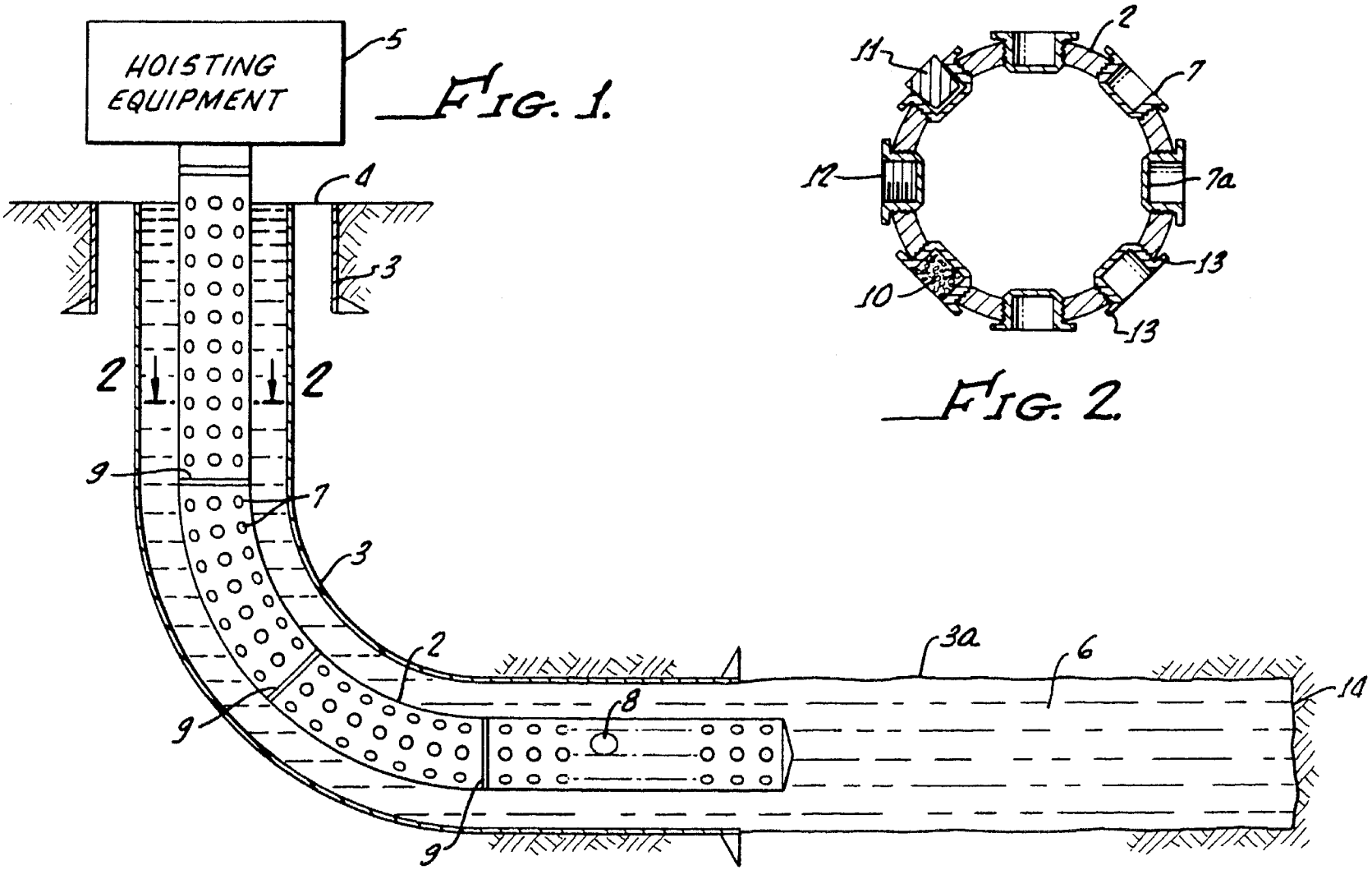
FIG. 1 shows a schematic side view of a pre-perforated and plugged flotation portion of a casing string being run into a previously installed casing string.
FIG. 2 shows a cross sectional view of the new casing at section line 2—2 as shown in FIG. 1.

FIGS. 1 and 2 show a schematic side view and a cross-sectional top view (at section 2—2) of a pre-perforated portion of a tubular string 2 being run into an underground wellbore. The tubular string 2 can be composed of a series of steel casing, liner, or drill pipe sections or may also be coiled or straight tubing as well as other conduit-like geometries and materials. The wellbore shown has a previously installed conductor and casing strings 3 extending from ground surface 4. The "new" casing string 2 is being run or lowered into the wellbore using conventional hoisting, drilling, and completion equipment 5, such as a drilling rig.

The previously installed strings 3 and wellbore contain a first fluid or fluid-like mixture 6. The first fluid 6 is preferably a relatively dense drilling mud mixture, such as a mixture of XCD, DRISPAC, and seawater, but may be a formation fluid or formation compatible fluids, The density or weight per gallon of the first fluid 6 is typically greater than water, e.g., at least 9.0 pounds per gallon (PPG), but may be as little as about 8.5 PPG. Since the density of the drilling mud used to drill the well must be greater than that required to keep the wellbore under control, i.e., a hydrostatic pressure greater than formation pressure, the drilling mud will typically be the (high density) first fluid 6 when the tubular is run.

The "new" casing string 2 is pre-perforated, i.e., contains perforations or other wall penetrations prior to being set in the wellbore, and the perforations are sealed with plugs 7. The perforations or penetrations of the casing string wall can be drilled and threaded, but may also be formed by a punch press, a perforating gun, or other conventional means. The perforations may also be formed as a result of the composition of the casing string 2, itself, e.g., a casing composed of helically wound wire or screen materials.

The plugs 7 are preferably shaped to be insertable, substantially hollow, and composed of a drillable aluminum. The plugs 7 can also be threaded to mate with threaded perforations of the casing 2 or rivet shaped. Most preferably, the shape allows manual insertion, i.e., shaped to be radially inward inserted into the perforations of casing 2.

The plugs 7 must typically also be able to withstand a significant differential pressure and form a substantially gas and liquid-tight seal of interior or flotation cavity 8 within casing 2. The plugged cavity 8 is used to contain a second fluid having a density less than first fluid 6, resulting in a buoyant force on the tubular when submerged in first fluid 6. Although the (buoyant) second fluid could theoretically be at the same pressure as the first fluid, the greater density of the first fluid results in greater hydraulic head pressures downhole. These high hydraulic pressures are difficult or impractical to duplicate within the tubulars, thus a significant (inwardly directed) differential pressure is typically present that must be resisted by the plugs 7.

The interior or buoyant cavity 8, as will be further described later, is evacuated or substantially filled with a second fluid less dense than first fluid 6, e.g., air or another-gas at ambient atmospheric conditions or a liquid such as a hydrocarbon distillate. The density difference of the plugged cavity 8 causes an upward buoyant force when the casing 2 is submerged within the first fluid 6.

The difference in fluid density also typically creates a pressure differential when the pre-perforated casing is submerged within the first-fluid-containing wellbore. A typical pressure differential (tending to force the plugs radially inward from the perforations) that the-plugs 7 must be able to withstand is about 1000 psi (68.0 atmospheres) for running tubulars to depths of about 2000 feet (609.6 meters), but the expected differential pressure for a shallow well (e.g., 500 feet below ground water) may be as little as about 250 psi (17 atmospheres) or less. To insure an adequate margin of safety, the plugs 7 are preferably capable of withstanding a differential pressure of at least twice the expected differential pressure, but a value only slightly greater than the expected differential pressure is tolerable if the user is willing to accept the risk of plug failure. The expected differential pressure that the plugs must withstand depends on the density of the first fluid (or mud weight) in the well and the vertical depth of the tubular within the well.

If the user desires even greater protection against the risk of plug failure or substantial leakage past the plugs 7, solid baffles or restrictors 9 can be provided to fragment the flotation cavity 8 into smaller flotation cavity portions. The fragmentation isolates a leak or at least partially fluid decouples leaks from other flotation cavity portions. The baffles 9 must also be capable of withstanding a substantial pressure differential similar to the plugs 7 and also must be easily unsealable, preferably by drilling.

More importantly, the baffles 9 prevent underbalance (well blowout) occurrences. If the integrity of even one plug 7 at the flotation cavity 8 is breached, the air or other light fluid contained within the cavity may displace the first fluid 6. If enough of the first fluid is displace, the hydrostatic pressure in the wellbore near the formation may be reduced to below that required to keep the formation under control. By using the baffles 9, the cavity portions can be designed so that the loss of a single cavity will not lower the hydrostatic pressure below that required for well control during drilling and completion operations.

The baffles 9 are preferably composed of aluminum, but may also be composed of other materials, such as steel or cast iron. Since the plugs 7 and baffles 9 are not exposed to adverse conditions for extended periods, a corrodible or decomposable material can be used. A frangible material or a frangible design may also be used for the baffles 7 or plugs 9.

The plugs 7 are generally hollow except at a solid end 7*a*. The plugs 7 are positioned in the perforations such that the solid end 7*a* protrudes past the interior wall surface of casing 2, i.e., inwards into cavity 8. As shown, the hollow portion of the plugs 7 also protrudes inwards beyond the interior wall surface of casing 2.

The open ends of the plugs 7 are placed proximate to the outer surface of casing string 2. The open ends of plugs 7 are shown in FIG. 2 as having flanges 13 circumferentially (measured from the centerline of the casing) extending beyond the outer surface and perforations in the casing 2. The flanges retain the plugs 7 in the perforation against the higher external pressure resulting from the greater density of fluid 6 when compared to thee pressure of the lower density fluid in the flotation cavity 8 during the running process. Although the flanges 13 are shown to be projecting away from the outer surface of casing 2 for clarity, the preferred configuration of the flanges is to be flush or at least minimally protrude outward from the casing 2. The flush or minimally protruding flanges help to reduce drag during running of the casing 2 into the existing casing 3 and wellbore portion 3*a*.

In order to reduce drag still further, the hollow portion of plugs 7 can be filled with a gap filler or other materials capable of excluding formation or other materials in the wellbore. The gap filler is not capable of withstanding the substantial differential pressure without the solid portion of the plug in place. Examples of a gap fillers shown in FIG. 2 include a gravel or other solid fill of the hollow portion with a frangible cover 10 (see FIG. 2) over the open end of the plugs 7, a cork or other elastomeric plastic material 11 press fit into the hollow portion of the plugs 7, or a fluid fill of the hollow portion with an inwardly directed, pop-through film or cover 12 over the opening of the plugs 7. These fill materials and/or other means for covering the hollow outer opening of plugs 7 can further reduce drag during running of the plugged tubulars.

The "lower" portion of the pre-perforated casing 2 is shown (in FIG. 1) entering the open portion of the wellbore 3*a*. This wellbore portion is typically drilled out, awaiting completion by setting the casing 2 in this portion of the wellbore 3*a*. Although the formation wall of this wellbore portion 3*a* is shown as a straight cylinder for clarity, the actual wall shape is expected to be an irregular cylinder.

Figure 3:
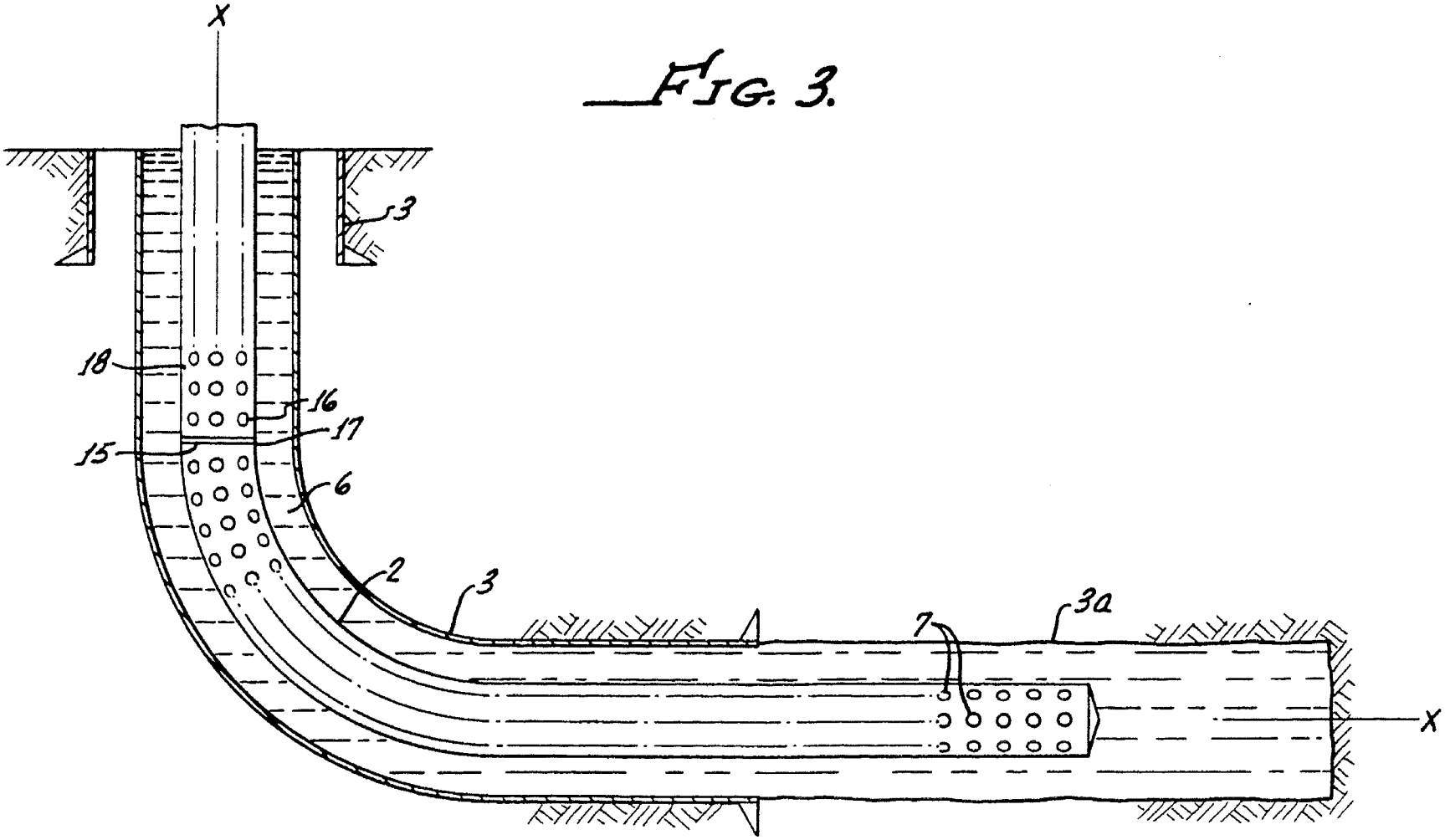
FIG. 3 shows a schematic side view of a non-flotation and flotation portions of a casing string being run into a previously installed casing string.

FIG. 3 shows the perforated tubular (specifically casing) 2 shown in FIG. 1 as the lower portion approaches the well bottom 14. The upper portion of the pre-perforated casing 2 can be isolated from the lower portion (having-perforations plugged with plugs 7) by an insert 15 which forms the upper end of the flotation cavity and the lower end of a non-flotation portion 18 of casing string 2. Isolation may also be achieved by using a solid baffle 9 or other means, e.g., a sliding or inflatable packer, for substantially sealing the top of the flotation cavity. The perforations 16 above the insert 15 are not plugged and the interior of the "new" casing 2 therefore fills with the first fluid 6 as the casing 2 is run within the previously installed casing 3 and wellbore portion 3*a*, increasing the effective weight of the upper portion of the casing 2.

The insert 15 is preferably installed within a coupling 17, but alternative means of retaining the insert in place within the casing 2 are also possible, such as inflating an inflatable packer or using shear pins attached to the walls of the casing 2. The insert 15 is preferably composed of a drillable material, such as aluminum, so that the insert is easily removable. Other materials of construction can include steel or cast iron.

In an alternative embodiment, the upper casing portion 18 may be composed of conventional (unperforated or pre-perforated) heavy weight drill pipe sections. The heavy weight casing or drill pipe 18 at the upper portion of the string tends to provide added force tending to run the tubular string toward the well bottom 14.

In another alternative embodiment, the lower casing portion 2 may be pre-perforated (and plugged) for only a portion of its length (along axis "x"). Even if the upper portion is not composed of heavy weight section, the lower casing portion may be composed of light weight sections to achieve advantages similar to using heavy weight sections in the upper portion 18.

Although FIG. 3 shows the casing 2 centered in the lower portion of the wellbore for clarity and this position is theoretically possible when a "buoyant" casing is run into the fluid-containing wellbore, the casing 2 will more likely be contacting the lower side of the deviated wellbore. Since the buoyant forces will tend to "lift" or at least reduce the effective weight of the plugged casing 2 bearing against the lower wellbore portion, sliding drag will be reduced even when the casing 2 contacts and slides against the (lower portion of the) prior installed casing 3 or wellbore 3*a*.

Figure 4:
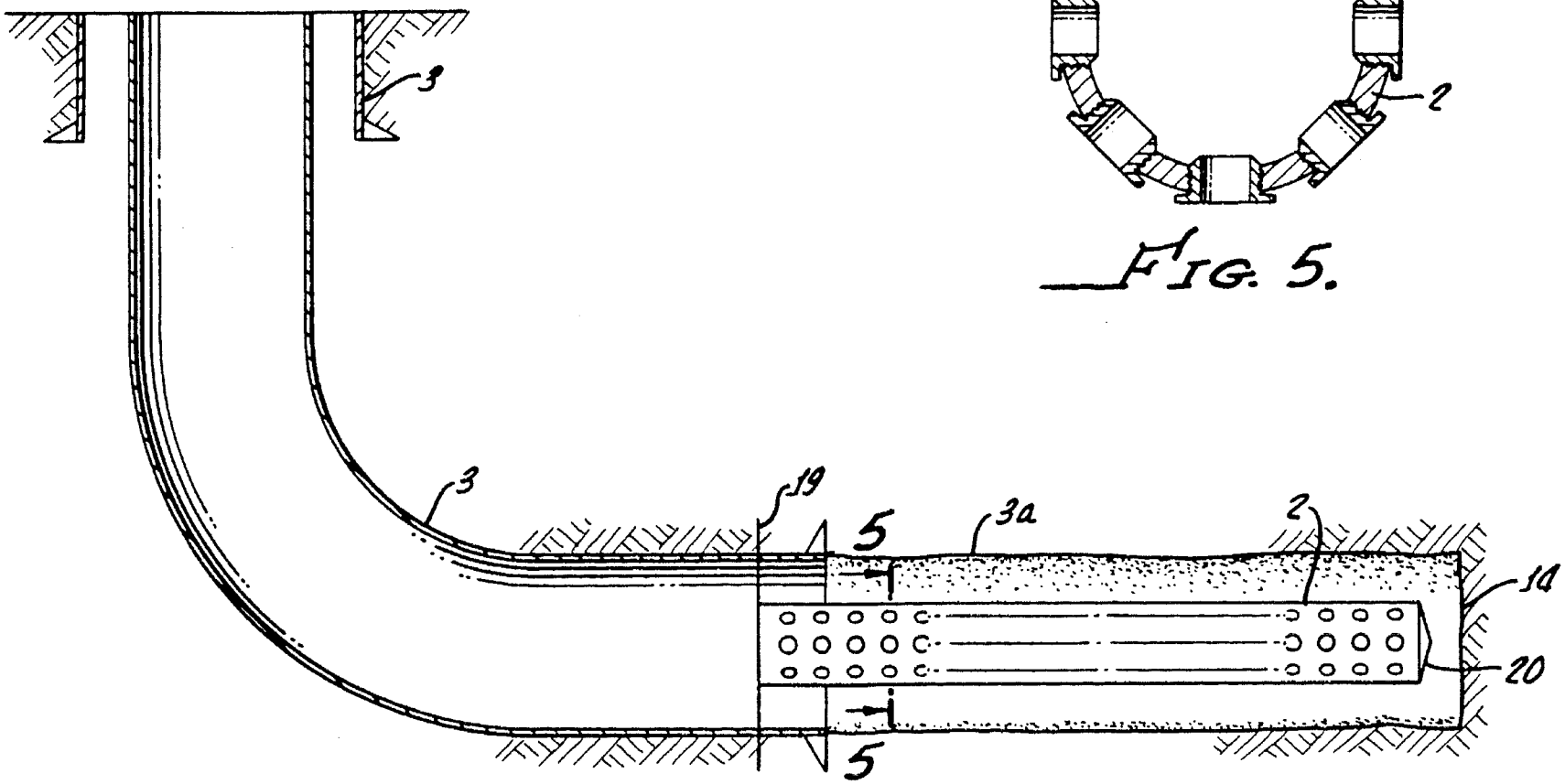
FIG. 4 shows a schematic side view of the flotation and non-flotation portions after interior portion of perforation plugs are drilled out.

FIG. 4 shows a side view of the pre-perforated casing 2 after being set and substantially located in wellbore portion 3*a*. Setting is preferably accomplished by attaching the upper end 19 to the previously installed casing 3 and removing the upper casing or drill string 18, but a portion of the casing may also be cemented to the wellbore formation walls or other completion steps may be accomplished. Although a lower end 20 of the pre-perforated casing 2 is shown proximate to the well bottom 14 after being set, alternative placements of the lower end 20 are also possible.

Figure 5:
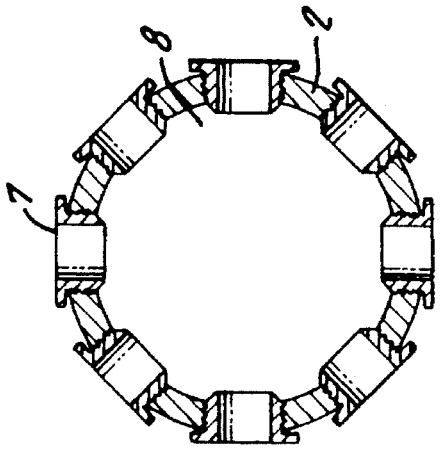
FIG. 5 shows a cross sectional view of the new casing at section line 5—5 as shown in FIG. 4.

FIG. 5 shows a cross-sectional view "5—5" of the pre-perforated casing shown in FIG. 4 after the insert 15 (as shown in FIG. 3) and the plugs 7 have been unsealed. The preferred method of unsealing the plugs 7 is to drill off the protruding solid end 7*a* (see FIG. 2) of the plugs. Although FIG. 5 shows the plugs 7 drilled out flush to the casing wall 2, the drilling out may also leave a portion of the internally protruding portions of the plugs, e.g., when one desires to minimize damage to the "new" casing during the drilling out process. All that is required to unseal is to open a conduit sufficient to transport fluid at the expected flowrate, e.g., removal of the solid end of the plugs allowing fluid to flow through the hollow portions of the plug.

Drilling out the insert 15 (see FIG. 3) allows the gas or other (buoyant) second fluid contained within the flotation cavity 8 to flow or rise (e.g., bubble up) to the surface. Unsealing the plugs 7 also allows the first fluid 6 to displace the second fluid. If an open end or a float shoe/collar is used at the lower end 20 of the "new" casing 2, the second fluid can be circulated and/or displaced into the wellbore or formation, e.g., with a cement or gravel slurry, after unsealing the insert (e.g., after drilling the insert 15) but prior to drilling out the plugs 7.

Figure 6:
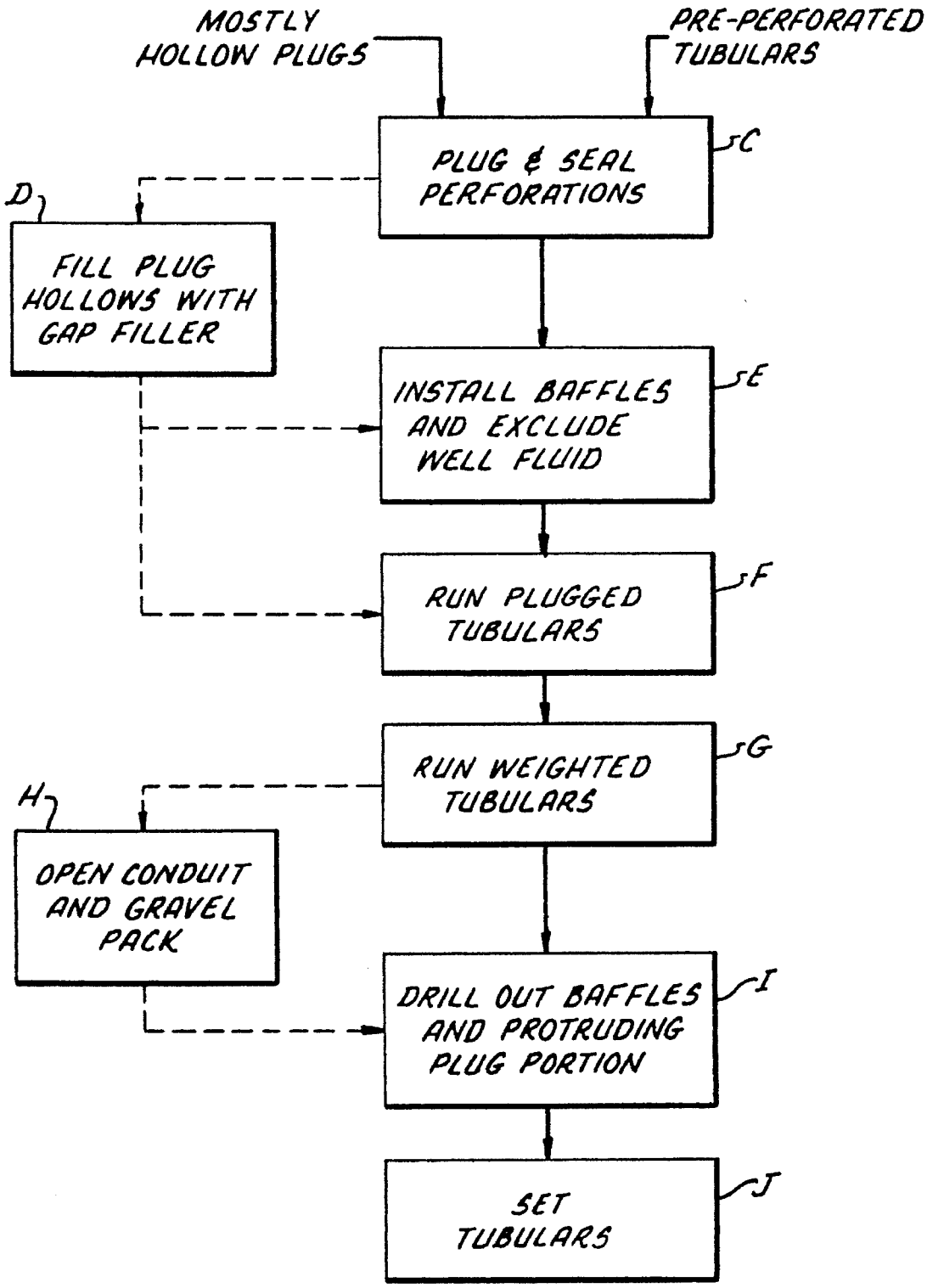
FIG. 6 shows a process for using the invention.

A process of using the invention is shown in FIG. 6. Perforations in a pre-drilled or otherwise perforated tubular are plugged using mostly hollow plugs inserted or screwed into the casing from a radially inward direction at step C, i.e., inwardly inserting plugs so that a removable solid portion protrudes into the interior space of the tubular. The plugs have an open end near the outer surface of the tubular. The plugs are capable of withstanding the expected pressure differential tending to force the plugs inward. A sealing compound, e.g., a pipe dope such as Loctite RC/609, is preferably added to further assure a leak tight seal of the perforations by the plugs.

A gap filler, such as an elastomeric material, may be inserted into the hollow portion of the plugs at optional step "D." The gap filler is not capable of withstanding the pressure differential if the solid end is removed, but excludes formation materials from the hollow portion until the solid end is removed.

Solid baffles are installed at every other joint of the tubular string at step "E." The baffles segment the tubular string into many smaller "buoyant" cavities instead of one large cavity. These smaller "buoyant" cavities avoid the risk of losing all of the lighter (lower density) fluid caused by a leak at one of the plugs.

Installing the baffles traps air into the "buoyant" cavities. Alternatively, an inert gas, e.g., nitrogen, or low density liquid when compared to water, e.g., oil, can be used to fill the buoyant cavities prior to installing and sealing the "buoyant" cavities with the baffles.

The plugged and "buoyant" tubulars are inserted or run into a wellbore containing a high density fluid, e.g., a water based completion fluid, at step "F." When immersed, the buoyant forces on the plugged tubulars tend to "lift" the tubulars off the lower side of an inclined hole portion, reducing sliding drag as the tubular is run into the wellbore. The "buoyant" tubulars are typically run as deep as possible, i.e., until the tubulars get "stuck."

If additional axial force is needed to run the buoyant, plugged tubulars further into the wellbore, a weighted drill string is attached to the plugged tubulars at step "G." The weighted segment being located in the near vertical portions of the well (see FIG. 3) tends to force the tubulars toward the well bottom even if the deviated well portion is inclined at an angle greater than 90 degrees (horizontal).

If the tubulars need to be gravel packed (or require some other completion step), this can be accomplished at step "H." The top portion of the "flotation" cavity is opened, e.g., by drilling out an insert and a gravel slurry (or other completion fluid) is circulated through the tubular and out into the formation faces.

The interior protruding portions of the plugs (and baffles if installed) are removed at step "I." The removal is typically accomplished by drilling or reaming out the interior portion of the tubulars. Removal of the solid portion of the plugs exposes the gap filler materials (if installed in the hollow portion of the plugs) to high pressure differentials and opens fluid conduits through the hollow portion of the plugs at the perforations. The gap filler materials are forced inward by the pressure differential and removed (up the tubulars) from the wellbore.

At step "J," the tubulars are set in the well The setting is typically accomplished by hanging the tubulars on other tubulars previously set in the wellbore. Cementing or other conventional setting steps are also possible.

Still other alternative embodiments are possible. These include: a plurality of plugs attached to each other at the open or flange ends such that several plugs can be inwardly inserted into the perforations at the same time (minimizing plug installation time and providing a smoother outer surface), using plugs composed of thermally degradable or acid reactive materials (allowing plug unsealing to be accomplished by acid or steam injection), and having a center conduit within the tubular (the buoyant cavity formed in the annulus between the conduit) to allow fluid circulation during running.

EXAMPLE

The invention is further described by an example which illustrates a specific mode of practicing the invention and is not intended as limiting the scope of the invention as defined by the appended claims. The examples are derived from testing in an offshore well located in the Santa Barbara Channel, Calif. A nominal 6 ⅝ inch (16.83 cm) diameter casing, having a weight of about 24 lb/foot (173.6 kg/meter), was perforated by drilling about ½ inch (1.27 Cm) nominal diameter penetrations of the casing wall along the axial length of about 4452 feet (1357.0 meters). The pre-perforated casing was plugged with aluminum plugs similar in shape to that shown in FIG. 2. After plugging and trapping air in the casing, 1795 feet (547.1 meters) of casing was run into the well. Unplugged casing was then used and the casing string run an additional 2657 feet (809.9 meters). The liner was run to a final total depth of about 5680 feet (1731.3 meters) and the protruding portion of the plugs were drilled out.

While the preferred embodiment of the invention has been shown and described, and some alternative embodiments also shown and/or described, changes and modifications may be made thereto without departing from the invention. Accordingly, the claims are intended to embrace all such changes, modifications, and alternative embodiments as fall within the spirit and scope of the appended claims.

What is claimed is:

1. An apparatus useful in installing a tubular into a deviated underground wellbore containing a liquid below a surface, said apparatus comprising:

a tubular portion having a substantially cylindrical wall and a plurality of perforations in a wall of said tubular portion along at least a portion of a lengthwise axis;

an insert substantially blocking fluid flow in a direction parallel to said axis when said insert is attached within said tubular portion, wherein said insert forms one end nearest said surface of a cavity within said tubular portion and said wall forms part of a side boundary of the cavity; and a plurality of plugs capable of substantially excluding said liquid from said cavity and containing within said cavity a fluid having a density less than said liquid when said plugs are inserted into said perforations from a substantially radially-inward direction relative to said axis.

2. The apparatus of claim 1 wherein said plugs have a substantially hollow core and a solid portion which protrudes inwardly beyond the interior wall of said tubular portion when said plugs are inserted into said perforations, said apparatus also comprising:

equipment capable of running said tubular portion into said deviated wellbore when said cavity contains a gas; and a float shoe attached to the tubular forming a distal end of said cavity wherein said tubular and plugs are capable of withstanding a substantially radially inward directed pressure differential of at least 250 psi.

3. An apparatus useful in installing a tubular into a deviated underground wellbore containing a liquid, said apparatus comprising:

a tubular portion having a substantially cylindrical wall and a plurality of perforations in a tubular wall along at least a portion of a lengthwise axis;

an insert substantially blocking fluid flow in a direction parallel to said axis when said insert is attached within said tubular portion, wherein said insert forms one end of a cavity within said tubular portion and said wall forms part of a side boundary of the cavity, wherein said insert also forms one end of a second cavity adjacent to the first cavity within the tubular;

a plurality of plugs capable of substantially excluding said liquid from said cavity when said plugs are inserted into said perforations from a substantially radially-inward direction relative to said axis, wherein said plugs have a substantially hollow core and a solid portion which protrudes inwardly beyond the interior wall of said tubular portion when said plugs are inserted into said perforations and wherein said plugs are capable of withstanding a substantially radially inward directed pressure differential of at least 250 psi;

equipment capable of running said tubular portion into said deviated wellbore when said cavity contains a gas;

a float shoe attached to the tubular portion forming a distal end of said cavity;

means for filling the second cavity with a second liquid; and means for substantially removing said insert and at least a portion of said plugs when said tubular portion is set within said wellbore.

4. The apparatus of claim 3 wherein each of said plugs have a major diametrical dimension of a solid portion at one end, wherein said dimension does not exceed a corresponding diametrical dimension of a mating perforation, and wherein said means for substantially removing is drilling out said solid portions.

5. An apparatus useful in installing a duct into a well containing a first fluid at a first pressure at an underground location below a surface, said apparatus comprising:

a duct segment having a plurality of perforations, said duct segment forming a portion of a wall of a cavity for containing a second fluid having a density less than said first fluid, said wall substantially excluding said first fluid from said cavity when said duct segment is installed into said well;

means for removably sealing said perforations when said duct segment is installed within said well;

means for containing said second fluid within said cavity such that a second fluid pressure within said cavity is substantially less than a first fluid pressure proximate to said cavity when said duct segment is located at said underground location, wherein said means for containing forms an upper end of said cavity and a lower end of a second cavity; and means for unsealing said perforations when said cavity is located at said underground location and flowing said second fluid towards said surface.

6. An apparatus useful in installing a duct into a well containing a first fluid at a first pressure at an underground location, said apparatus comprising:

a duct segment having a plurality of perforations, said duct segment forming a portion of a walls of a cavity for containing a second fluid having a density less than said first fluid, said walls substantially excluding said first fluid from said cavity when said duct segment is installed into said well;

means for removably sealing said perforations when said duct segment is installed within said well;

means for filling said cavity with said second fluid such that a second fluid pressure within said cavity is substantially less than a first fluid pressure proximate to said cavity when said duct segment is located at said underground location; and means for unsealing said perforations when said flotation cavity is located at said underground location;

means for sealing an upper end of said cavity; and means for removing said second fluid from said cavity through said tubular.

7. The apparatus of claim 6 which also comprises a plurality of solid baffles segmenting said cavity into smaller cavity portions.

8. The apparatus of claim 7 wherein said second fluid is not miscible with said first fluid and which also comprises means for limiting inflow of said first fluid into said cavity, wherein said means for limiting inflow is attached to said duct and forms a distal end of said cavity.

9. The apparatus of claim 8 wherein said means for sealing one end comprises a packer-like device.

10. The apparatus of claim 9 which also comprises a second duct segment which is attached to and heavier per unit length than said first duct segment.

11. The apparatus of claim 10 wherein said means for removably sealing perforations comprises plugs having a mostly hollow core, said plugs being insertable into said perforations from a radially inward direction, said apparatus also comprising a gap filler material substantially contained within the hollow core.

12. The apparatus of claim 11 wherein said means for unsealing is a drill capable of removing an inwardly protruding portion of said plugs when inserted in said perforations.

13. A process useful in installing a pre-perforated duct segment having a lengthwise axis within a well containing a first fluid, said process comprising:

inserting plugs into said perforations from a substantially radially inward direction with respect to said axis and forming a plugged duct segment;

attaching an axial fluid flow restricting device to said duct segment to form one end of a cavity within said plugged duct Segment capable of containing a second fluid having a density less than said first fluid when said plugged duct segment is installed in said well;

installing said duct segment into said well;

removing at least a portion of said axial fluid flow restricting device; and removing at least a portion of said plugs when inserted in said perforations wherein fluid flow through at least a portion of said perforations is enabled.

14. The process of claim 13 wherein said fluid flow restricting device and said plug portion are capable of being removed by drilling.

15. A process useful in installing a duct segment having perforations along a longitudinal axis within a cavity containing a first fluid, said process comprising:

attaching radial inflow restriction devices to said perforations;

attaching an axial flow restriction device to said duct segment, wherein said duct segment and said restriction devices form a flotation portion substantially containing a second fluid which is less dense than said first fluid when said duct segment is translated into a position within said cavity;

translating said flotation portion into said position within said cavity such that a first fluid pressure proximate to said flotation portion exceeds a second fluid pressure within said flotation portion by at least about 250 psi; and drilling out at least a portion of said axial flow restriction device and removing said second fluid from said flotation cavity.

16. The process of claim 15 wherein the attaching an axial flow restriction device step comprises attaching a plurality of axial flow restriction devices along said longitudinal axis.

17. The process of claim 16 which also comprises the step of drilling out a portion of said radial inflow restriction devices, wherein said drilling out a portion of said radial inflow restriction devices enables a radially inward flow of said first fluid when said duct segment is located at said position.

18. The process of claim 17 which also comprises the step of flowing a gravel packing slurry through said duct segment after the step of drilling out said axial flow restriction device.

19. The process of claim 18 wherein said cavity is a subsurface borehole, said duct segment is a casing string, said first fluid is a drilling mud, and said second fluid is air, said process also comprising the step of attaching a second duct segment which does not include a flotation portion after said translating step.

20. An apparatus useful in installing a perforated duct segment into a well containing a first fluid at an underground location below a surface, said apparatus comprising:

a plurality of plugs for sealing said perforations and forming a portion of a wall of a cavity for containing a second fluid having a density less than said first fluid;

an insert substantially located within said duct segment and sealing an upper end of said cavity, wherein said insert allows said cavity to be substantially filled with said second fluid when said duct segment is within said well; and a tool for removing said second fluid from said cavity through said duct segment towards said surface and for unsealing said plugs at said perforations when said cavity is located at said underground location.

21. An apparatus useful in installing a duct into a well containing a first fluid at an underground location, said apparatus comprising:

a duct segment having a plurality of perforations;

a plurality of plugs removably sealing said perforations;

an insert substantially located within said duct segment and forming one end of a cavity, wherein said insert allows said cavity to contain said second fluid; and a baffle segmenting said cavity into cavity portions.

* * * * *

UNITED STATES PATENT AND TRADEMARK OFFICE

CERTIFICATE OF CORRECTION

PATENT NO. : 5,456,317

DATED : October 10, 1995

INVENTOR(S) : Hood, III, et al.

It is certified that error appears in the above-indentified patent and that said Letters Patent is hereby corrected as shown below:

On the Cover sheet, Item [76] Inventors: after "300 Sawgrass" delete "La" and insert in place thererof -- Lane --.

Colulmn 7, Claim 1, line 60, after "liquid below" delete "a" and insert in place thereof -- the earth's --.

Signed and Sealed this

Ninth Day of January, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,456,317
DATED : October 10, 1995
INVENTOR(S) : John L. Hood, III, et al.

It is certified that error appears in the above-indentified patent and that said Letters Patent is hereby corrected as shown below:

On the title page:

After Item [76] please insert the following separate item: -- [73] Assignee: Union Oil Company of California, Los Angeles, Calif. --.

Signed and Sealed this

Tenth Day of September, 1996

*Attest:*

Bruce Lehman

BRUCE LEHMAN

*Attesting Officer*

*Commissioner of Patents and Trademarks*